United States Patent [19]

Noack

[11] 4,096,090

[45] * Jun. 20, 1978

[54] CATALYZED HYDRAZINE COMPOSITIONS AND METHODS OF THEIR USE

[75] Inventor: Manfred G. Noack, Northford, Conn.

[73] Assignee: Olin Corporation, New Haven, Conn.

[ * ] Notice: The portion of the term of this patent subsequent to May 3, 1994, has been disclaimed.

[21] Appl. No.: 763,195

[22] Filed: Jan. 27, 1977

Related U.S. Application Data

[63] Continuation-in-part of Ser. No. 606,550, Aug. 21, 1975, Pat. No. 4,012,195.

[51] Int. Cl.[2] ..... C23F 11/18; C23F 11/14

[52] U.S. Cl. ..... 252/389 R; 21/2.5 R; 21/2.7 R; 106/14.14; 252/390; 252/400 R

[58] Field of Search ..... 252/389 R, 390, 400 R; 21/2.7 R, 2.5 R; 106/14

[56] References Cited

U.S. PATENT DOCUMENTS

| | | | |
|---|---|---|---|
| 2,270,577 | 1/1942 | Bergstrom et al. | 252/401 X |
| 3,551,349 | 12/1970 | Kallfass | 252/390 X |
| 3,556,748 | 1/1971 | Stedman | 252/401 X |
| 3,625,888 | 12/1971 | Redmore et al. | 252/389 R X |
| 3,639,263 | 2/1972 | Troscinski et al. | 21/2.7 R X |
| 3,645,896 | 2/1972 | Larsen | 21/2.7 R X |
| 3,686,123 | 8/1972 | Hiroshi | 21/2.7 R X |
| 3,687,610 | 8/1972 | Gilson et al. | 252/180 X |
| 3,785,995 | 1/1974 | Kalil | 252/384 X |
| 4,026,664 | 5/1977 | Noack | 252/389 R X |

*Primary Examiner*—Richard D. Lovering
*Attorney, Agent, or Firm*—William A. Simons; T. P. O'Day

[57] ABSTRACT

Corrosion inhibiting compositions are described which contain a hydrazine compound, an organometallic complex and preferably a quinone compound. The organometallic complex is the reaction product of a cobaltous or manganous hydroxide and one or more aromatic ligands containing at least two hydroxy functional groups, or at least one amino and one hydroxy group, in the ortho position with respect to one another. The quinone compound is preferably added to these compositions in order to render the compositions compatible with chelating phosphonate scale control agents. The use of these compositions as oxygen scavengers in corrosive environments is also described.

26 Claims, No Drawings

CATALYZED HYDRAZINE COMPOSITIONS AND METHODS OF THEIR USE

CROSS-REFERENCES TO RELATED APPLICATIONS

This application is a continuation-in-part application of U.S. Patent Application Ser. No. 606,550, filed on Aug. 21, 1975, now U.S. Pat. No. 4,012,195, by the present inventor, and entitled "Catalyzed Hydrazine Compound Corrosion Inhibiting Composition and Use". This application is also related to U.S. Patent Application Ser. No. 689,229, filed on May 24, 1976, now U.S. Pat. No. 4,026,664, by the present inventor, and entitled "Catalyzed Hydrazine Compound Corrosion Inhibiting Composition Containing a Quinone Compound and a Complex of Metal Salt and an Ortho Aromatic Compound".

BACKGROUND OF THE INVENTION

A. Field of the Invention

The present invention relates to catalyzed hydrazine compound corrosion inhibiting compositions and their use in corrosive environments. More particularly, the present invention relates to compositions comprising a hydrazine compound, a catalytic organometallic complex which enhances oxygen scavenging and, preferably, a quinone compound which renders the composition compatible with chelating phosphonate scale control agents. The present invention further relates to the uses of these compositions to inhibit or reduce corrosion or to remove oxygen.

B. Description of the Prior Art

It is well known to use hydrazine compounds for the removal of oxygen from gases and liquids to retard the corrosion of metal surfaces. Among the more important commercial uses of hydrazine compounds for this purpose are in water and steam apparatus such as boilers, hot water heating systems and water cooling systems. These hydrazine compounds are also used in inorganic and organic fluid heat exchange systems, e.g., alkylene glycol coolant systems. It is believed that the hydrazine compound reacts in these systems whereby the hydrogen from the hydrazine compound combines with the oxygen to form water or other compounds so as to bind up the oxygen and thereby inhibit corrosion.

The rate of reaction of a hydrazine compound, e.g., hydrazine, monomethyl hydrazine or the like, with oxygen at ambient temperatures or lower, is relatively slow. As a result, numerous suggestions have been made in the art to add catalytic or accelerating agents to the hydrazine compound or to modify hydrazine-containing systems to facilitate oxygen removal or scavenging in fluidic corrosive environments or to otherwise treat water systems. Thus, various hydrazine compound systems have been suggested. Examples are described in U.S. Pat. Nos. 3,551,349 to Kallfass, 3,639,263 to Troscinski et al, 3,645,896 to Larsen, 3,687,610 to Gilson et al, 3,728,281 to Marks et al, 3,808,138 to Yamaguchi et al, 3,843,547 to Kaufman et al, 3,983,048 to Schiessl et al and in Japanese Kokai No. 155,048/75 assigned to Kurita.

In the two related patent applications mentioned above having the same inventor as herein, it was described that certain organometallic complexes, when used in combination with a hydrazine compound in corrosive environments, significantly increase the rate of reaction of the hydrazine compound in removing oxygen, even to a surprisingly significant degree at ambient or lower temperatures. In particular, the organometallic complexes described therein had not heretofore been taught or suggested in the prior art literature and are high performers as oxygen scavenging catalysts for hydrazine compounds. Further, the inclusion of the quinone compounds described in U.S. Patent Application Ser. No. 689,229 filed on May 24, 1976, now U.S. Pat. No. 4,026,664, was discovered to additionally aid in the compatibility of these compositions with commercially used chelating phosphonate scale control agents in said corrosive environments.

Although the compositions described in these two patent applications are highly effective in removing dissolved oxygen from liquids and inhibiting corrosion of metals exposed in said liquids, certain impurities and inconveniences arise from their preparation. Specifically, in the making of the organometallic complexes, it was taught to react an inorganic salt of cobalt, manganese or copper (e.g., containing anions such as chloride, nitrate, bromide, iodide or sulfate) with certain organic ligands to obtain the catalytic complex. When these complexes are combined with the hydrazine compound (and preferably, in some instances, also with a quinone compound) to obtain the described corrosion-inhibiting compositions, the anions in the inorganic salt were left as impurities in the final product.

In processes such as deoxygenation of feed water for low and medium pressure stream generators, the presence of these anions is judged to be harmless. However, in certain applications (e.g., in the feed water for high-pressure boilers having a pressure of about 1500 psig or more) the presence or use of these anion-producing inorganic salts is undesirable because the tolerances to impurities in such systems is very low. Moreover, the employment of certain anions (e.g., nitrates) may cause a fire hazard to arise from mixing the inorganic salt with the hydrazine compound. For example, if cobalt nitrate hexahydrate is mixed in a certain ratio with hydrazine hydrate, the resulting solution may self-ignite upon heating at approximately 80° C. Therefore, when a catalyzed hydrazine solution is to be prepared with the use of the above cobalt nitrate, it is a normal practice to first combine the hydrazine compound with the organic ligand and then add to them a dilute solution, preferably aqueous, of the above cobalt nitrate. However, this multi-step addition procedure and the prior dilution of the cobalt inorganic salt is not desirable on a large commercial production scale for cost and processing reasons. Instead, it would be more advantageous to employ a simplified method of addition of these three components with no prior dilution of any of them.

BRIEF SUMMARY OF THE INVENTION

Accordingly, the present invention is an improvement upon the catalyzed hydrazine compositions and methods of their use described in the above-mentioned related patent applications. Specifically, this improvement relates to employing either cobaltous or manganous hydroxide instead of the inorganic salts of these transition metals to form the catalytic organometallic complexes. By making this substitution, the impurity problem cited above is overcome and the method of preparation may be simplified.

DETAILED DESCRIPTION

The novel compositions of the present invention contain a hydrazine compound, a catalytic organometallic complex and preferably, a quinone compound. The hydrazine compound employed in the compositions of the present invention may be hydrazine itself or it may be any of the hydrazine compounds which function as oxygen scavengers in fluidic corrosive environments. Thus, hydrazine compounds such as methylhyrazine, ethylhydrazine, propylhydrazine, butylhydrazine, 1,1-dimethylhydrazine, 1,1-dibutylhydrazine, and higher alkylated hydrazine compounds, hydroxy alkyl hydrazines, for example, hydroxyethyl hydrazine, as well as aromatic and aralkyl hydrazine compounds, may be employed. The hydrazine compound may be any of these or a mixture of these and may be used in anhydrous form or in an aqueous solution.

Most preferred of these compounds is hydrazine itself. Moreover, an aqueous solution of hydrazine is preferred when the composition is to be used in water-based corrosive environments. And, when organic fluid environments are involved, hydrazine may be used in an organic solution, e.g., in a lower alkylene glycol solution. Furthermore, in addition to the above hydrazine compounds, inorganic and/or organic salts thereof may be employed to replace part or all of these hydrazine compounds wherever they are compatible with the fluidic system. Suitable inorganic hydrazine compounds which may be used include hydrazine phosphate, hydrazine monohydrochloride and dihydrochloride, hydrazine monohydrobromide and dihydrobromide, monohydrosulfate and dihydrosulfate and the like. Of course, if these latter salts are employed, the undesirable anion impurities may become present in the mixture.

When the above hydrazine compounds are employed in either an aqueous, inorganic or organic solution, any workable solvent may be used as long as the solvent is compatible with the fluidic corrosive environment which is to be treated. There is no criticality in the amount of solvent employed because the solvent will be compatible with and may become part of the system which is to be treated. However, as a practical and economical matter, regardless of the solvent chosen, generally at least about 1 mole to about 100 moles, and preferably about 1.5 moles to about 20 moles of the solvent is used per mole of hydrazine compound. The exact amount may be somewhat influenced by the particular hydrazine compound chosen or simply may be dictated by the commercial availability of particular solutions. For example, when an aqueous solution is used, the solution may contain about 5 to about 64 percent hydrazine compound by weight, based on the total weight of the water and the hydrazine compound. When an organic solution is used, it may contain about 5 to about 40 percent by weight of hydrazine compound, for example, based on the total weight of the organic solvent and the hydrazine compound.

The organometallic complex used in the compositions of the present inventions are the reaction products of cobaltous or manganous hydroxide and selected organic ligands. In most cases, the cobaltous hydroxide ($Co(OH)_2$) is favored over manganous hydroxide ($Mn(OH)_2$) because of its faster rate of oxygen removal. However, both hydroxides, along with unstable hydroxides such as cobaltic or manganic hydroxides, are suitable for the present invention. These latter forms (i.e., $Co(OH)_3$ and $Mn(OH)_3$) normally will quickly reduce down to the cobaltous or manganous form in the presence of the above hydrazine compounds. Cobaltous and manganous hydroxide are both available commercially in various forms (e.g., "hydrate" or dry powder, aqueous suspensions or slurries and the like) which can be readily used in the present invention. It has been surprisingly discovered that these hydroxides of cobalt and manganese which are normally insoluble in water or only slightly soluble in an aqueous hydrazine solution will dissolve readily and form the catalytic complex when sufficient ligand is present. Moreover, as stated above, no undesirable impurities are introduced into the corrosion-inhibiting composition when the hydroxide (rather than an inorganic salt) is employed.

In order to form the organometallic complex used in the composition of the present invention, this hydroxide is reacted with one or more organic ligands selected from the group consisting of unsubstituted and substituted ortho-dihydroxy aromatic compounds and unsubstituted and substituted ortho-aminohydroxy aromatic compounds. The preferred organic ligands are the ortho-dihydroxy aromatic compounds, of which, 1,2-dihydroxybenzene is the most preferred. These organic ligands are ortho substituted aromatic compounds which may have only one aromatic ring or may have two or more rings. The substituents which may be part of the organic ligand include any which do not interfere with the formation of the organometallic complexes and with the oxygen scavenger accelerating function of the compositions of the present invention and will include alkyl, aralkyl and aryl groups, e.g., having about 1 to about 10 and preferably about 1 to about 4 carbon atoms, as well as inorganic substituents such as the sulfonic acid radical. While the two functional groups on the organic ligands are in the ortho positions relative to one another, the inert substituents may be located in any of the positions not occupied by the two functional groups.

Exemplary of the organic ligands which may be used in forming the organometallic complexes used in the composition of the present invention are:

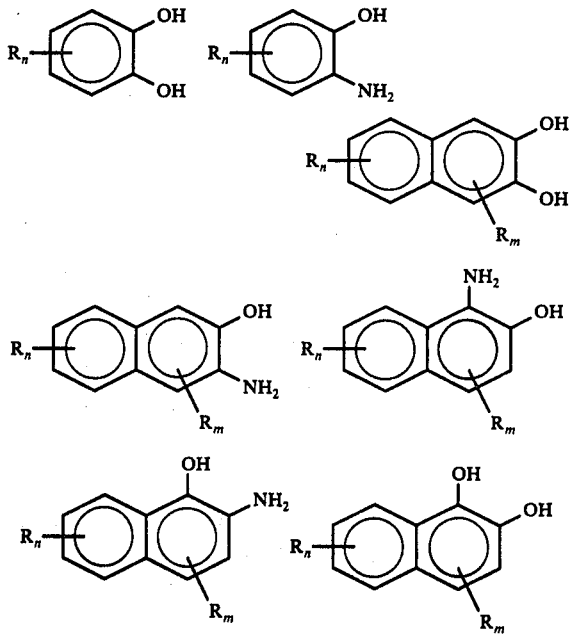

wherein $n$ is an integer from 0 to 4, $m$ is an integer from 0 to 2 and each R is a substituent which does not affect the formation of the organometallic complex and does not detrimentally affect the corrosion-inhibiting catalytic functionality of the molecule, e.g., lower alkyl, aralkyl, alkaryl, $—SO_3H$, $—PO_3H_2$ and the like. Also, exemplary of the ligands which are useful in the composition and method of the present invention are the anthracene, phenanthrene and phenylene compounds corresponding to those shown above.

In forming the organometallic complexes, the hydroxide is reacted with the organic ligand so that about 0.1 to about 20 or even more gram-moles, and preferably about 0.5 to about 5 gram-moles of ligand is used per gram-atom of metal ion. Within these ranges, the optimum ratios of these two reactants will in general depend upon the particular ligand which is employed. Illustrative optimum ratios will be from about 2 to about 4 gram-moles for either the o—dihydroxy aromatic compound or an o-aminophenol compound per gram-atom of metal ion.

These two components may advantageously be combined and reacted at room temperature and at atmospheric pressure. However, lower or higher temperatures and negative or positive pressures may be employed, if desired. Thus, temperatures ranging from about 10° C or lower to about 100° C or higher, and preferably from about 20° C to about 50° C, and pressures from as low as 5 psi or lower up to about 30 psi or higher, and preferably within the range of from about 10 psi to about 15 psi, may be used. At any rate, it can be seen that any combination of temperature and pressure may be used in preparing the organometallic complex provided that there is no significant detrimental effect on the reaction or on the desired products.

The reaction of the hydroxide and the organic ligand generally occurs in a reasonably short period of time and a significant amount of organometallic complex is obtained within a matter of minutes. The resulting organometallic complex may be dissolved in the reaction mixture or it may precipitate out of the reaction mixture. Regardless of the particular form of the organometallic complex, the complex is compatible with the reaction mixture and may be stored therein for an indefinite period of time. Because the reaction occurs in most cases within one hour, and because the desired product may be stored in the reaction mixture, there is no criticality to the maximum residence time involved in the reaction between the hydroxide and the organic ligand used in the present invention. However, if desired, the organometallic compound may be separated from the reaction mixture by any conventional means, e.g. by filtration or by distillation of the solvent. Alternatively, the organometallic compound need not be separated from the reaction mixture and the entire entity may be used as a component for the composition of the present invention.

The quinone compound which is used in preferred embodiments of the present invention may be any quinone compound which renders the composition compatible with known chelating phosphonate scale control agents. Among the quinone compounds which may be used for the para-quinones, para-hydroquinones, para-naphthoquinones, para-anthraquinones, para-hydronaphthoquinones, para-hydroanthraquinones and the like, as well as their substituted derivatives. These include alkyl and aryl substituted quinone compounds as well as those having hydrophilic substituents. Among the desired quinone compounds which may be used are the alkylated and arylated para-quinones and para-hydroquinones having about 1 to about 10 carbon atoms in the substituent, and those having substituents which are either derivatives of carboxylic acids, sulfonic acids, carboxylic acid alkali metal salts, or sulfonic acid alkali metal salts. Preferred are the lower alkyl para-quinones and para-hydroquinones having 1 to 5 carbon atoms in the alkyl substituent. Of these, most preferred is methylhydroquinone, also known as toluhydroquinone.

In the present invention organometallic complexes as described above are combined with the hydrazine compound, and preferably also with the quinone compound, to form the compositions of the present invention. In general, at least about 0.0005 parts, preferably in the range of about 0.002 parts to about 0.10 parts, by weight of an organometallic complex are combined with one part by weight of the hydrazine compound. In the most preferred embodiment of the present invention, from about 0.005 parts to about 0.02 parts by weight of the organometallic complex are employed per part of the hydrazine compound. The use of amounts of organometallic complex below the lowest limit cited above results in a certain reduction in the catalytic effect on the oxygen-scavenging action of the hydrazine compound. The use of amounts of organometallic complex above the relative 0.1 parts by weight normally are uneconomical and do not give any further improvement to the desired catalytic action. However, it may be desirable to store and/or ship the compositions in a concentrated form whereby the amount of organometallic complex is greater than this upper limit. Such concentrated solution are also encompassed by the present invention.

The quinone compound is preferably combined in amounts of at least about 0.0005 parts, more preferably in amounts of at least 0.001, and most preferably in the range of from about 0.005 parts to about 0.02 parts, by weight with one part by weight of the hydrazine compound. Amounts of quinone compound below the lowest limit cited herein start to lose the desired effect. Furthermore, amounts of quinone compounds above about 0.1 parts by weight are uneconomical and do not have any beneficial effect to the present compositions. However, since it may be desirable to store and/or ship these compounds in concentrated form, there is no upper limit as to amounts of quinone compound in the compositions of the present invention.

In one preferred embodiment, the organometallic complex, the quinone compound and the hydrazine compound may be combined prior to use of the resulting composition as a corrosion inhibitor, or the three components may be added separately or in any suitable combination to the fluid in the system to be treated. As alternatives to combining the organometallic complex and the quinone compound with the hydrazine compound, either before or after being added to the fluidic corrosive environment to be treated, other approaches may advantageously be used. In one preferred embodiment, the organic ligand may be dissolved in a hydrazine compound solution and the hydroxide either in solid or suspension form may subsequently be combined with the organic ligand-hydrazine compound solution, either before or after the organic ligand-hydrazine compound solution is added to the fluidic system to be treated, and the quinone compound may be added at any time.

In another preferred embodiment of the present invention, the hydroxide may first be suspended in a hydrazine compound solution and then the organic ligand may be combined therewith either before or after the hydroxide-hydrazine compound solution is added to the fluidic system to e treated and the quinone compound may be added to any component at any time. It should be noted that in those embodiments wherein the hydroxide and the organic ligand are not combined until added to the fluidic system to be treated, the organometallic complex is formed in situ. It should also be noted that regardless of the particular combining approach taken, the relative amounts of hydrazine compound, organic ligand, hydroxide and quinone compound used are those set forth above. Therefore, it is clearly understood that the order of addition of the above-mentioned components to the environment is not critical and any suitable method which results in the desired catalytic effect is encompassed within the scope of the present invention.

In summary, the above compositions are used to inhibit oxygen corrosion in fluidic corrosive environments. These compositions are generally combined with the system to be treated so that at least about a stoichiometric amount of hydrazine compound is present based on the amount of dissolved oxygen in the system. Typically, this may mean that the composition is used so that the hydrazine compound concentration in the fluidic system, after admixing, but before reaction with the dissolved oxygen takes place, is in the range of about 0.001 to about 1,000 ppm, e.g., about 0.01 to about 400 ppm. The particular method used in combining the corrosion-inhibiting compositions of the present invention may be any of those which have been previously described and the physical techniques of addition may be any of those which are well known in the art with respect to the use of hydrazine as a oxygen scavenger. Likewise, the methods of determining the amount of oxygen present in the fluidic system are well known in the art and need not be described herein.

The following examples are given to further illustrate the present invention. All percentages and proportions are by weight unless expressly stated otherwise.

EXAMPLE 1

Composition with Co/1,2-Dihydroxybenzene Catalyst 400 mg 1,2-dihydroxybenzene and 70 ml distilled water are added to 88 ml of hydrazine hydrate in a nitrogen-blanketed stirred flask. A weighed quantity of 172 mg cobaltous hydroxide hydrate is subsequently transferred quantitatively to the flask from a tared container by rinsing with 1 ml of distilled water. Complete dissolution of the cobaltous hydroxide is achieved after stirring for several minutes. No anionic impurities are present in the resulting composition.

EXAMPLE 2

Composition with Mn/1,2-Dihydroxybenzene Catalyst

The procedure of Example 1 was followed except that 0.164 g $Mn(OH)_2$ were added to the aqueous solution containing the hydrazine and the 1,2-dihydroxybenzene. The resulting composition, a clear colorless solution, contained no anionic impurities from the use of manganous salt.

EXAMPLE 3

Composition with Mn/o-Aminophenol Catalyst

Quantities of approximately 200 mg o-aminophenol, 35 ml distilled water and 44 ml hydrazine hydrate are combined in a nitrogen-blanketed stirred flask. Subsequently, one adds approximately 86 mg manganous hydroxide and obtains a somewhat cloudy solution of catalyzed hydrazine corrosion-inhibiting composition.

EXAMPLE 4

Composition with Co/Dihydroxybenzene/Toluhydroquinone Catalyst 498 mg toluhydroquinone are dissolved in approximately 160 ml of the solution prepared in accordance with Example 1 to obtain a corrosion-inhibiting hydrazine solution.

EXAMPLE 5

Composition with Mn/Dihydroxybenzene/Toluhydroquinone Catalyst

A quantity of 498 mg toluhydroquinone (synonym methyl-hydroquinone) was added to a solution prepared in accordance with Example 2.

EXAMPLE 6

Composition with Mn/o-Aminophenol/Toluhydroquinone Catalyst

The preparation of solution in accordance with Example 3 was repeated except that approximately 250 mg toluhydroquinone were added.

EXAMPLE 7

Measurement of Rate of Oxygen Removal

To measure rates of oxygen removal, one places approximately 1060 ml of a solution containing approximately 7 ppm dissolved $O_2$ and sodium bicarbonate and carbonate (to give a pH of 10) in a stirred Erlenmeyer flask. The flask is fitted with a selective membrane electrode for measurement of dissolved oxygen concentration. A hydrazine solution without catalyst, and the catalyzed hydrazine solutions in accordance with Examples 1 through 6 are then injected in each test in sufficient quantity to bring $N_2H_4$ concentration before reaction with oxygen occurs to 150 ppm. The subsequent decrease in oxygen concentration is recorded as a function of time.

An examination of times required for oxygen removal as summarized in Table I demonstrates the accelerating effect of the catalyst prepared in accordance with this invention.

TABLE I

Oxygen Removal with Catalyzed Hydrazine Solutions

| Solution Of Example No. | Catalyst | Time (min.) Required for Removal Of 25 | 50 | 75 | 95% of $O_2$ |
|---|---|---|---|---|---|
| — | None | 7.0 | — | — | — |
| 1 | $Co^{++}$/DHB[a] | 2.0 | 4.0 | 6.0 | 8.0 |
| 2 | $Mn^{++}$/DHB | 1.3 | 3.3 | 6.5 | — |
| 3 | $Mn^{++}$/OAP[b] | 3.2 | 6.6 | 10.8 | — |
| 4 | $Co^{++}$/DHB/THQ[c] | 0.1 | 0.2 | 0.3 | 0.7 |
| 5 | $Mn^{++}$/DHB/THQ | 0.1 | 0.3 | 0.9 | 1.5 |
| 6 | $Mn^{++}$/OAP/THQ | 0.1 | 0.2 | 0.4 | 0.8 |

[a]DHB = 1,2-dihydroxybenzene
[b]OAP = o-aminophenol
[c]THQ = toluhydroquinone (synonym: methylhydroquinone)

What is claimed is:

1. A composition comprising:

(a) a hydrazine compound; and (b) from about 0.0005 parts to about 0.1 parts by weight of an organometallic complex per part of hydrazine compound, said organometallic complex being the reaction product of:

(i) a hydroxide selected from the group consisting of cobaltous hydroxide and manganous hydroxide; and (ii) one or more organic ligands selected from the group consisting of unsubstituted and substituted ortho-dihydroxy aromatic compounds and unsubstituted and substituted ortho-aminohydroxy aromatic compounds.

2. The composition of claim 1 wherein said hydroxide is cobaltous hydroxide.

3. The composition of claim 1 wherein said hydrazine compound is hydrazine.

4. The composition of claim 1 wherein said ligand is an unsubstituted ortho-dihydroxy aromatic compound.

5. The composition of claim 1 which includes at least about 0.0005 parts by weight of a quinone compound per part of hydrazine compound.

6. The composition of claim 5 wherein said hydrazine compound is hydrazine, said organometallic complex is the reaction product of cobaltous hydroxide and an unsubstituted ortho-dihydroxy aromatic compound and said quinone compound is a para-quinone, a para-hydroquinone, a para-naphthoquinone, a para-anthraquinone, a para-hydronaphthoquinone, a para-hydroanthraquinone, or a substituted derivative thereof.

7. The composition of claim 6 wherein said ortho-dihydroxy aromatic compound is 1,2-dihydroxybenzene.

8. The composition of claim 7 wherein said quinone compound is methylhydroquinone.

9. The composition of claim 8 wherein about 0.005 parts to about 0.02 parts by weight of the organometallic complex is used per part of hydrazine compound.

10. The composition of claim 9 wherein about 0.005 parts to about 0.02 parts by weight of said quinone compound is used per part of hydrazine compound.

11. The composition of claim 1 wherein about 0.002 parts to about 0.1 parts by weight of the organometallic complex is used per part of hydrazine compound.

12. The composition of claim 1 which includes about 0.001 parts to about 0.1 parts by weight of a quinone compound per part of hydrazine compound.

13. The composition of claim 1 wherein said hydrazine compound is in an aqueous solution containing about 5 to about 64 percent hydrazine by weight, based on the total weight of the water and the hydrazine compound.

14. A method of treating a fluidic corrosive environment to remove oxygen therefrom and inhibit corrosion therein, which comprises: treating said environment with a composition comprising:

(a) a hydrazine compound; and (b) from about 0.0005 parts to about 0.1 parts by weight of an organometallic complex per part of hydrazine compound, said organometallic complex being the reaction product of:

(i) a hydroxide selected from the group consisting of cobaltous hydroxide and manganous hydroxide; and (ii) one or more organic ligands selected from the group consisting of unsubstituted and substituted ortho-dihydroxy aromatic compounds and unsubstituted and substituted ortho-aminohydroxy aromatic compounds.

15. The method of claim 14 wherein said hydroxide is cobaltous hydroxide.

16. The method of claim 14 wherein said hydrazine compound is hydrazine.

17. The method of claim 14 wherein said ligand is an unsubstituted ortho-dihydroxy aromatic compound.

18. The method of claim 14 which includes at least about 0.0005 parts by weight of a quinone compound per part of hydrazine compound.

19. The method of claim 18 wherein said hydrazine compound is hydrazine, said organometallic complex is the reaction product of cobaltous hydroxide and an unsubstituted ortho-dihydroxy aromatic compound and said quinone compound is a para-quinone, a para-hydrouinone, a para-naphthoquinone, a para-anthraquinone, a para-hydronaphthoquinone, a para-hydroanthraquinone, or a substituted derivative thereof.

20. The method of claim 19 wherein said ortho-dihydroxy aromatic compound is 1,2-dihydroxybenzene.

21. The method of claim 20 wherein said quinone compound is methylhydroquinone.

22. The method of claim 21 wherein about 0.005 parts to about 0.02 parts by weight of the organometallic complex is used per part of hydrazine compound.

23. The method of claim 22 wherein about 0.005 parts to about 0.02 parts by weight of said quinone compound is used per part of hydrazine compound.

24. The method of claim 14 wherein about 0.002 parts to about 0.1 parts by weight of the organometallic complex is used per part of hydrazine compound.

25. The method of claim 14 which includes about 0.001 parts to about 0.1 parts by weight of a quinone compound per part of hydrazine compound.

26. The method of claim 14 wherein said hydrazine compound is in an aqueous solution containing about 5 to about 64 percent hydrazine by weight, based on the total weight of the water and the hydrazine compound.

* * * * *